US007040194B2

(12) United States Patent
Wu et al.

(10) Patent No.: US 7,040,194 B2
(45) Date of Patent: May 9, 2006

(54) JAR OPENER

(75) Inventors: Lin Feng Wu, Shen Zhen (CN); Chun Yu Liu, Shen Zhen (CN)

(73) Assignee: Main Power Electrical Factory Ltd., Kowloon, Hong Kong (CN)

( * ) Notice: Subject to any disclaimer, the term of this patent is extended or adjusted under 35 U.S.C. 154(b) by 71 days.

(21) Appl. No.: 10/915,911

(22) Filed: Aug. 11, 2004

(65) Prior Publication Data

US 2006/0032336 A1 Feb. 16, 2006

(51) Int. Cl.
*B67B 7/18* (2006.01)

(52) U.S. Cl. ..... 81/3.2; 81/3.4

(58) Field of Classification Search ..... 81/3.2, 81/3.25, 3.31, 3.33, 3.36, 3.37, 3.29, 3.4, 81/3.42, 3.44; 53/331.5, 317
See application file for complete search history.

(56) References Cited

U.S. PATENT DOCUMENTS

| | | | | |
|---|---|---|---|---|
| 2,026,118 | A * | 12/1935 | Barnby | 81/3.2 |
| 2,034,878 | A * | 3/1936 | Podel | 81/3.2 |
| 3,950,801 | A | 4/1976 | Morrison | |
| 4,052,917 | A | 10/1977 | Gee | |
| 4,766,781 | A | 8/1988 | Grisé et al. | |
| 5,617,765 | A | 4/1997 | Bennett | |
| 5,647,251 | A | 7/1997 | Hardman | |
| 6,089,124 | A | 7/2000 | Murphy | |
| 6,182,534 | B1 | 2/2001 | Hardman | |
| 6,862,954 | B1 * | 3/2005 | Dubois et al. | 81/3.2 |

* cited by examiner

*Primary Examiner*—Debra S Meislin
(74) *Attorney, Agent, or Firm*—Alix, Yale & Ristas, LLP

(57) ABSTRACT

A jar/bottle opener has a housing, a first pair of opposed jaws for gripping a jar or bottle and a second pair of opposed jaws for gripping a jar or bottle closure. A driven shaft operates the first and second jaws and turns the second jaws relative to the first jaws.

5 Claims, 6 Drawing Sheets

JAR OPENER

BACKGROUND OF THE INVENTION

1. Field of the Invention

The invention relates to an opener for a container having a screw- or twist-off closure, commonly referred to as a jar opener.

2. Description of Prior Art

It is often difficult to open a jar or container having a screw- or twist-off lid, sealed under vacuum conditions, by hand. Various devices are available to grip the lid and provide leverage to rotate it. However, these still pose a problem as the user must grip the jar or bottle and hold it firmly against the rotational forces.

Mechanical devices are available which hold the jar or bottle while loosening the lid. These devices have a cone shaped member for gripping the lid and apply downwards pressure on the cone to grip the jar or bottle against a base. Such devices are not efficient as the downward pressure increases the rotational force needed to loosen the lid.

SUMMARY OF THE INVENTION

It is an object of the present invention to provide an opener for a container having a screw- or twist-off closure which overcomes or ameliorates the above-mentioned problems.

According to the present invention, there is provided an opener for a container having a screw or twist off closure comprising:

- a housing,
- a rotational drive shaft having a stationary position,
- a first rotational guide and a first spring connecting the first guide to the housing, the first spring having a deflected position storing rotational energy when the shaft is in the stationary position,
- a second rotational guide coaxial with the first guide,
- a first pair of opposed jaws slidably provided on the first guide,
- a first coupling device connecting the first jaws to the housing so that rotation of the first guide causes movement of the first jaws along the first guide,
- a second pair of opposed jaws slidably provided on the second guide,
- a second coupling device connecting the second jaws to the shaft so that rotation of the shaft causes movement of the second jaws along the second guide, and
- the shaft being rotatable in a first direction to move the second jaws to engage a closure of a container between the jaws, and thereby rotational energy in the first spring is released to move the first jaws to engage the container.

Preferably the opener further includes a second spring connecting the second guide to the first guide, the second spring being deflectable to store rotational energy when the shaft rotates in the first direction.

Preferably the opener further includes a switch for causing the shaft to rotate in an opposite direction after the closure has been rotated relative to the container.

Preferably the second coupling device includes a cam coupled to the shaft and arms between the cam and second jaws.

Preferably the shaft encloses a movable pin, the pin protruding from an end of the shaft and movable to start the shaft rotating when the container is placed between the jaws.

Further aspects of the invention will become apparent from the following drawings and description.

BRIEF DESCRIPTION OF THE DRAWINGS

Embodiments of the invention will now be described by way of example only and with reference to the accompanying drawings in which.

DESCRIPTION OF THE PREFERRED EMBODIMENTS

Figure 1:
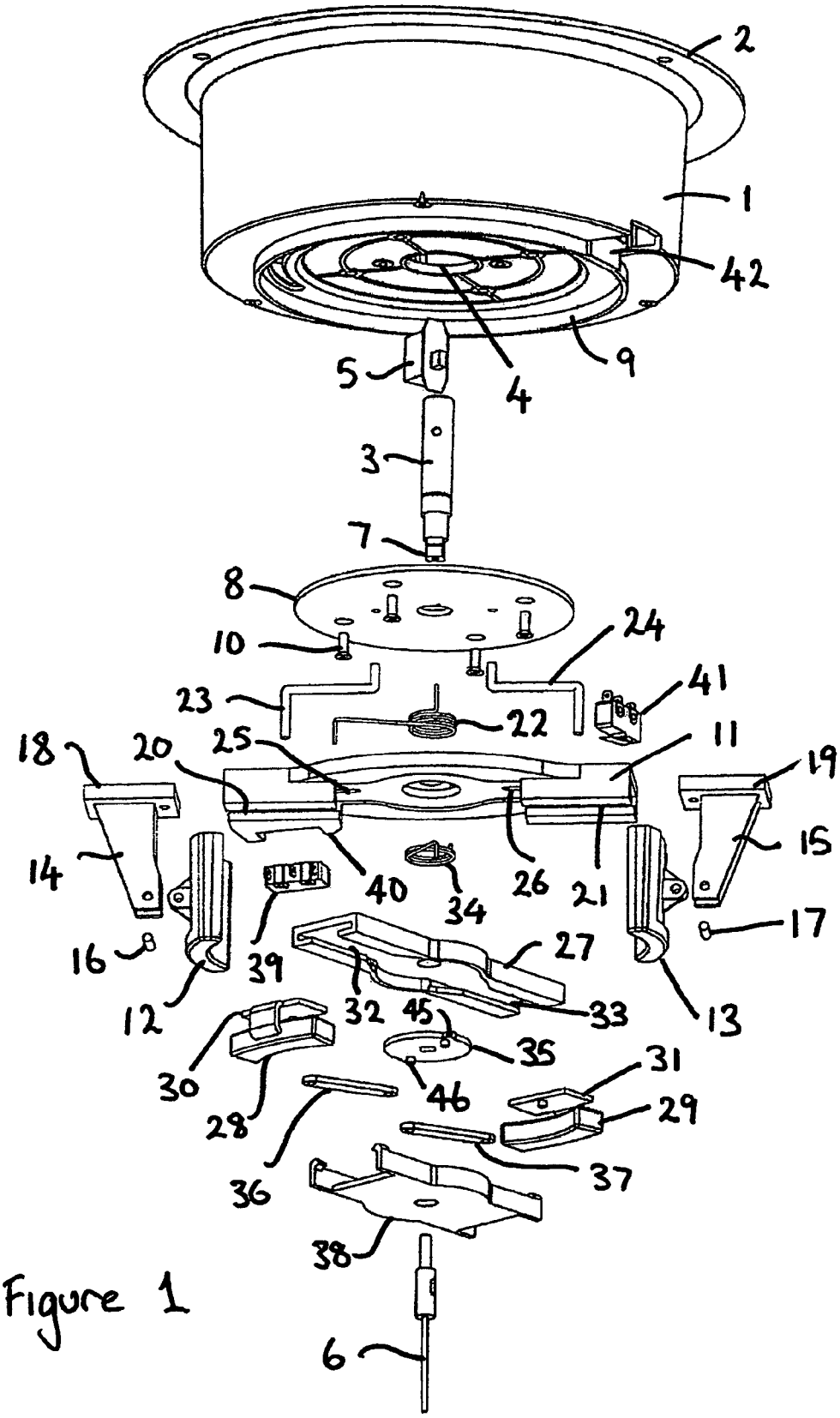
FIG. 1 is an exploded view of a jar opener according to the invention.

Referring to the drawings, a jar opener according to the invention includes a housing 1 in which a drive motor is located. The housing has an upper flange 2 so that it can be mounted on the underside of eye level cupboards or the like. A hollow drive shaft 3 coupled to the motor extends through an opening 4 in the underside 9 of housing 1. A start switch 5 is located proximate the top of the drive shaft 3. An activation pin 6 is slidably located within the hollow drive shaft 3 and extends through the open lower end 7 of the drive shaft. When an object is brought into contact with the lower end 7 of the drive shaft it moves the activation pin 6 causing it to operate the start switch 5 starting the motor.

A fixed plate 8 having an opening at its centre is fixed to the underside 9 of the housing with screw fasteners 10. The fixed plate 8 is positioned about, but not coupled to, drive shaft 3.

Figure 5:
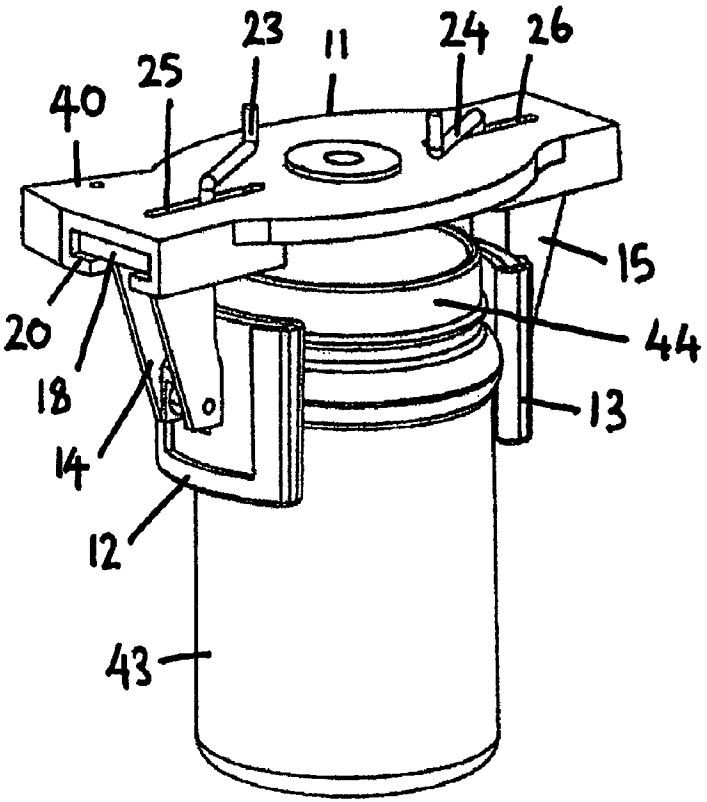
FIGS. 4 and 5 show jar gripping jaws of the jar opener.
Figure 4:
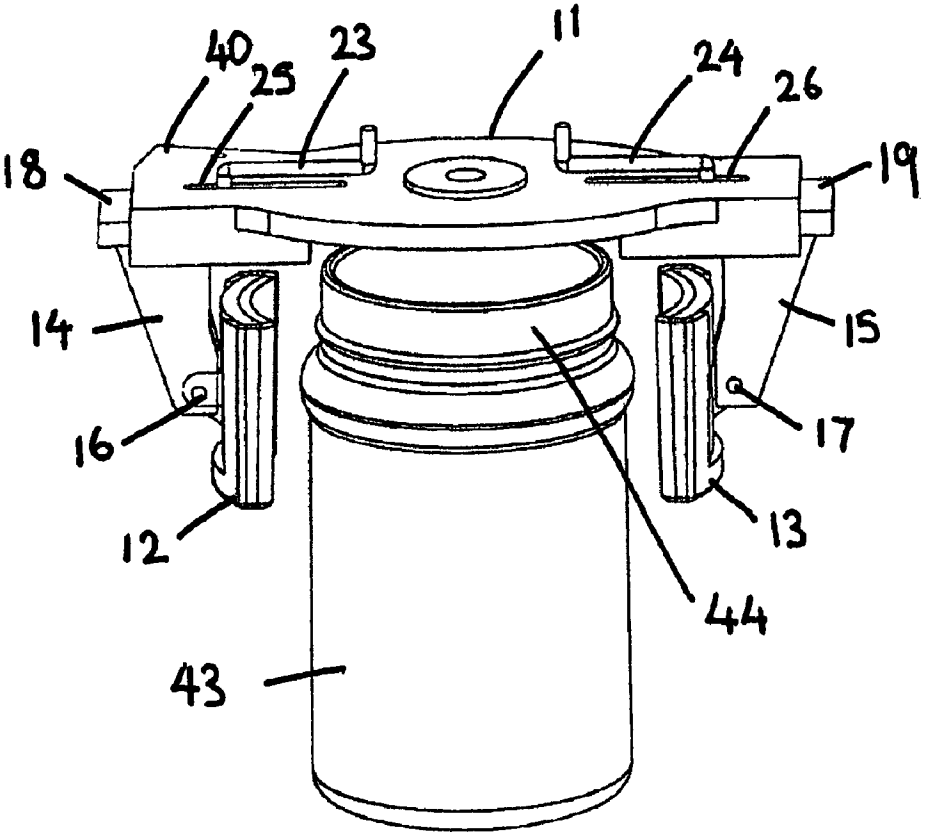

A jar clamp assembly comprises an elongate jar/bottle clamp guide 11 having an opening at its centre through which the shaft 3 passes and a first pair of opposed arcuate gripping jaws 12/13 pivotally mounted to T-shaped sliding blocks 14/15 by pins 16/17. The sliding blocks have flanges 18/19 that are received within complementally shaped open channels 20/21 at each end of guide 11. The jar clamp assembly is rotatably mounted adjacent fixed plate 8 and the clamp guide 11 is coupled to the fixed plate 8 by a first torsion spring 22. First torsion spring 22 is deflected in an anti-clockwise direction under load and rebounds in a clockwise direction when released as viewed in the drawings. The spring 22 is deflected under load when the device is in the initial position, depicted in FIG. 8, prior to use. During operation spring 22 is released and rebounds providing rotational energy to rotate guide 11. The sliding blocks 14/15 are also coupled to the fixed plate 8 by a pair of linkages 23/24 passing through slots 25/26 in the guide 11. When jar guide 11 turns the sliding blocks 14/15 move along the channels 20/21 causing the opposed gripping jaws 12/13 to firmly engage opposite portions of a jar or bottle positioned between them. This is illustrated by FIGS. 4 and 5.

A closure clamp assembly comprises an elongate closure clamp guide 27 having an opening at its centre through which the shaft 3 passes and a second pair of arcuate opposed gripping jaws 28/29 mounted to sliding plates 30/31. The sliding plates 30/31 are received within complementally shaped channels 32/33 at each end of closure guide 27. The closure clamp assembly is rotatably mounted adjacent the jar clamp assembly and the closure guide 27 is coupled to the jar guide 11 by a second torsion spring 34. The second torsion spring 34 is deflected in a clockwise direction under load and rebounds in an anti-clockwise direction when released as viewed in the drawings. The second torsion spring 34 is free (unloaded) when the device is in the initial position, depicted in FIG. 8, prior to use.

Figure 7:
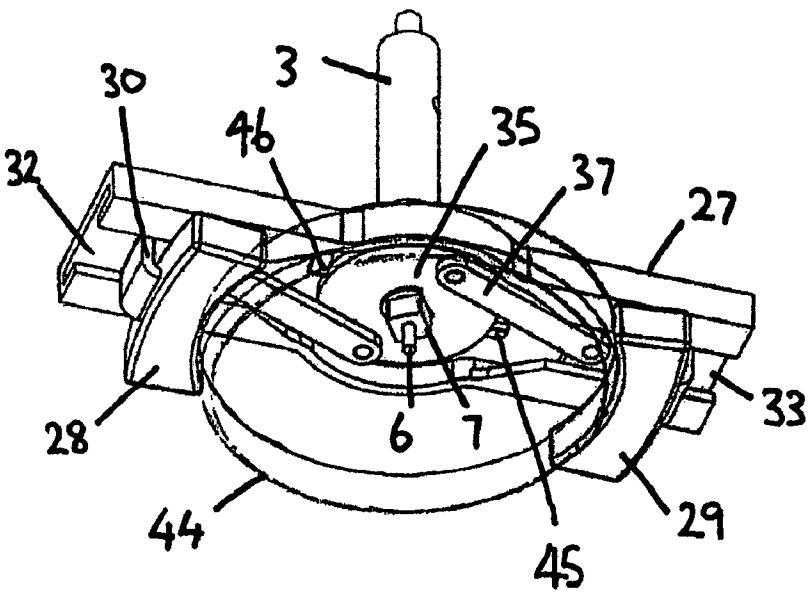
FIGS. 6 and 7 show lid gripping jaws of the jar opener.
Figure 6:
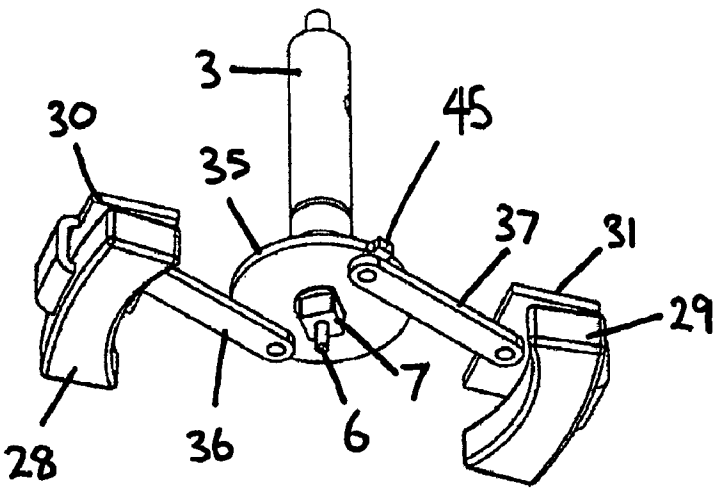
Figure 12:
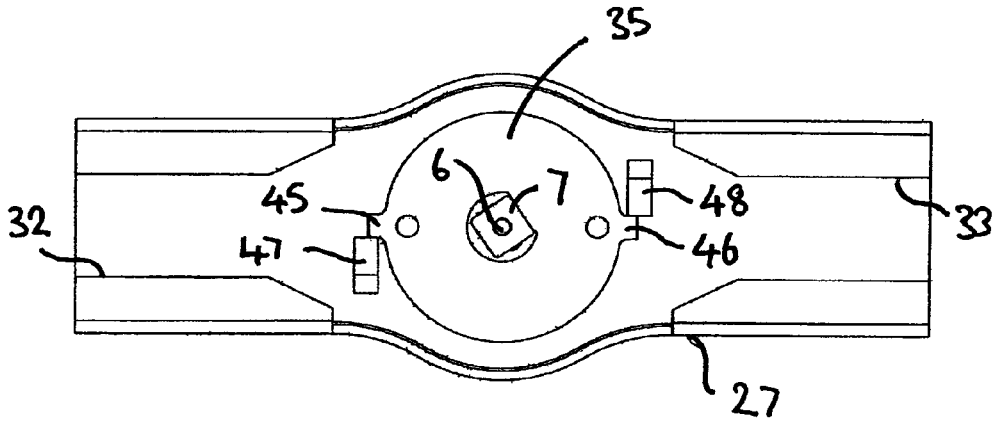
FIG. 12 is a partial view of part of the jar opener showing additional detail.

A cam plate 35 is fixedly mounted to the lower end 7 of the drive shaft 3 between channels 32/33. The sliding plates 30/31 are coupled to cam plate 35 by a second pair of linkages 36/37 passing along channels 32/33 in guide 27. A lower cover 38 encloses cam plate 35 and linkages 36/37 within channels 32/33. When the drive shaft 3 and cam plate 35 rotate the sliding plates 30/31 move along the channels 32/33 causing the opposed gripping jaws 28/29 to firmly engage opposite portions of a jar or bottle closure positioned between them. This is illustrated by FIGS. 6 and 7. The cam plate 35 has two diametrically opposite tabs 45, 46 on its periphery. Referring to FIG. 12, there are two small blocks 47 and 48 provided on closure clamp guide 27 proximate the periphery of cam plate 35. The tabs 45, 46 and blocks 47, 48 provide limits to the relative rotation between the cam plate 35 and the closure clamp guide 27, such that torsion springs 22, 34 are deflected or released depending on the direction cam plate 35 rotates.

The sliding blocks 14/15 have relatively longer arms than sliding plates 30/31 to support the jar gripping jaws 12/13 below the closure gripping jaws 28/29 so they grip the jar below the closure when the jar is in the conventional 'upright' position with its closure uppermost. The jar gripping jaws 12/13 are pivotally mounted to sliding blocked 14/15 so they can tilt to firmly grip jars or bottles with tapered or curved side walls. The inner arcuate gripping surfaces of the jar and closure jaws 12/13, 28/29 are made of rubber or plastics material suitable for frictionally gripping glass, ceramic, metal surfaces and the like.

A reverse switch 39 is mounted to a bracket 40 on the side of jar clamp 11. Reverse switch 39 instructs the motor to rotate in the opposite direction. A stop switch 41 is mounted to a bracket 42 on underside 9 of the housing 1. The positioning of the reverse and stop switches 39, 41 will become apparent from the following description of operation of the jar/bottle opener.

Figure 3:
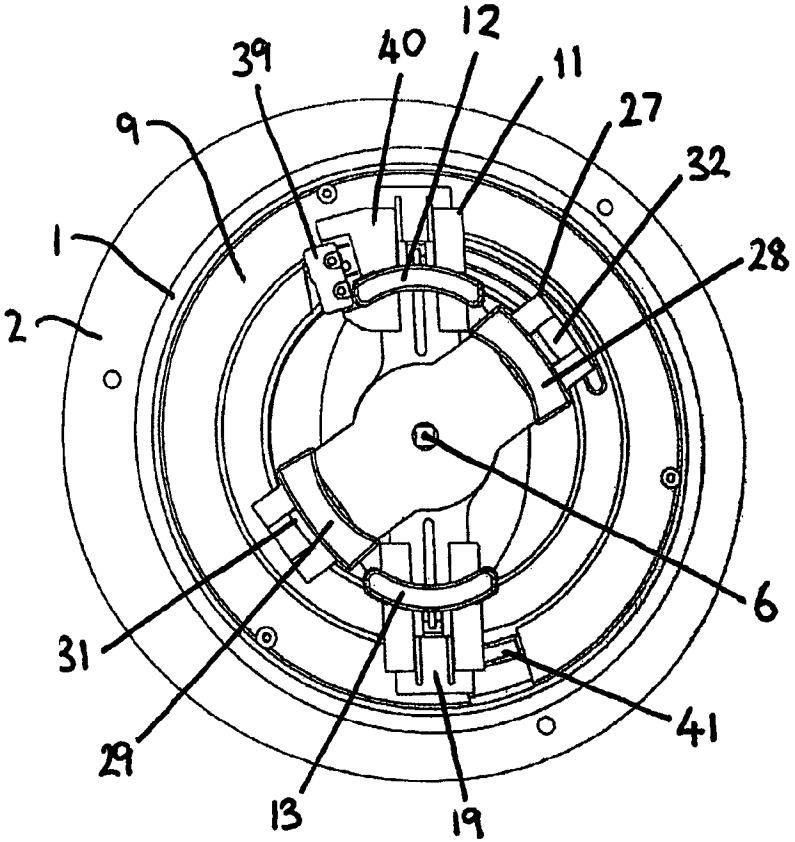
FIG. 3 is a bottom view of the jar opener.
Figure 2:
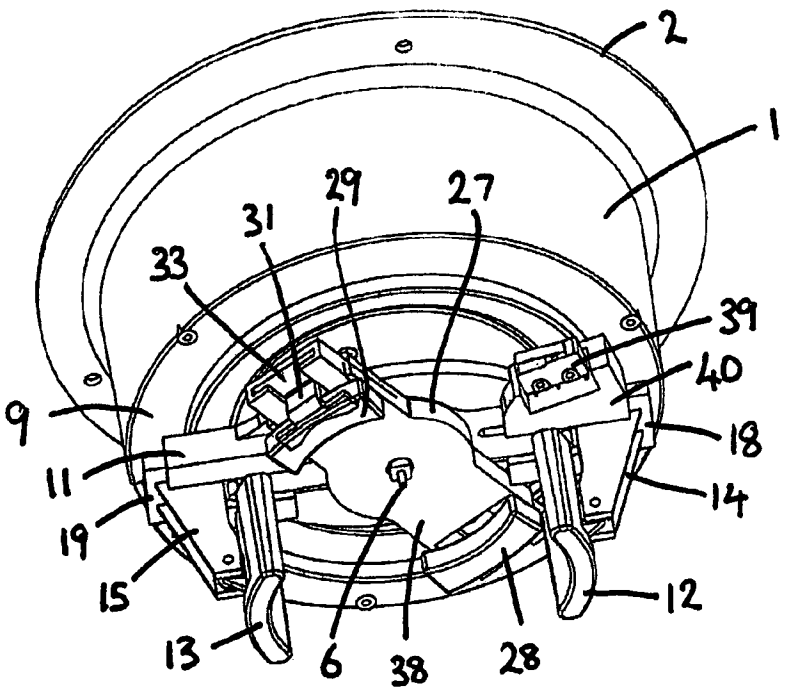
FIG. 2 is a bottom perspective view of the jar opener.
Figure 10:
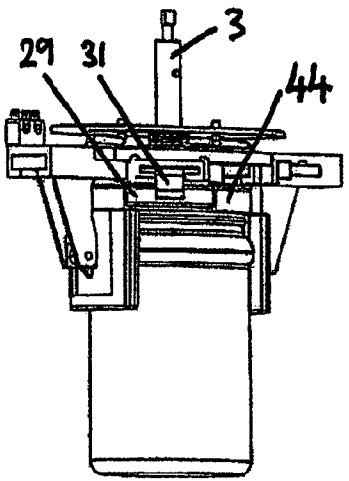
Figure 9:
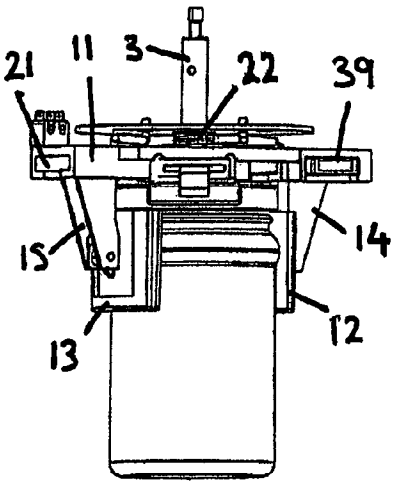
Figure 8:
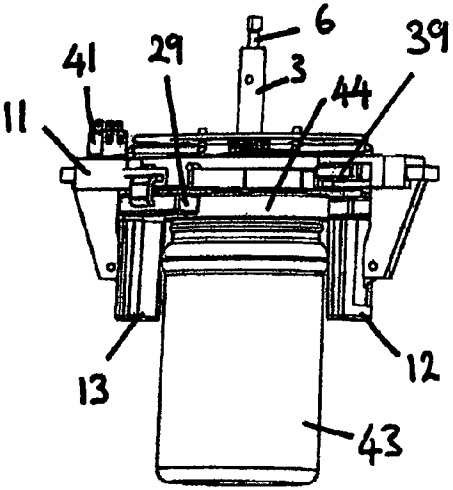

FIGS. 8 to 10 illustrate operation of the device. In FIGS. 3 and 8 the jar opener is in its ready position with the opposed jar and closure jaws 12/13, 28/29 in the open most position. The clamp guides 11, 27 are held against the torque of torsion spring 22 by tabs 45, 46. A jar or bottle 43 is placed between the jaws 12/13, 28/29 with its closure 44 uppermost so as to depress activation pin 6 which resets the device and starts the motor.

Referring to FIG. 9, the drive shaft 3 rotates cam 35 in the clockwise direction and torsion spring 22 is released to rebound and cause clamp guide 11 to turn. The sliding blocks 14/15 move along the channels 20/21 causing the opposed jar gripping jaws 12/13 to engage opposite portions of the jar or bottle 43. When the jar gripping jaws 12/13 firmly engage the jar or bottle the clamp guide 11 is prevented from turning further. Torsion spring 34 between guide 11 and guide 27 causes a rotational force in the opposite (anti-clockwise) direction to adjust the pressure between the gripping jaws 12/13.

Referring to FIG. 10, the drive shaft turns cam plate 35 and sliding plates 30/31 move along the channels 32/33 causing the closure gripping jaws 28/29 to firmly engage the jar or bottle closure 44. Initially, closure guide 27 moves in fixed relation to clamp guide 11. When the closure gripping jaws 28/29 engage the jar or bottle closure the sliding plates 30/31 are prevented from moving along the channels 32/33 and closure guide 27 begins to turn in a clockwise direction deflecting second torsion spring 34 under load.

Figure 11:
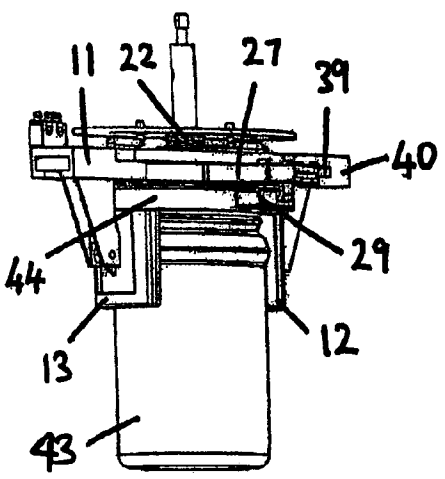
FIGS. 8 to 11 illustrate stages of jar opening.

Referring to FIG. 11, the jar guide 11 is prevented from turning and closure guide 27 begins to turn relative to it. This causes the closure 44 to rotate relative the jar or bottle 43 breaking any vacuum seal and freeing the closure 44. When the closure guide 27 moves through about 70 degrees relative to the jar guide 11 it operates the reverse switch 39 causing the motor to rotate in opposite direction. Cam 35 is turned in the anti-clockwise direction. Load on second torsion spring 34 is released and it rebounds moving jar guide 11 to its initial position. When tabs 45, 46 engage blocks 47, 48 of closure guide 27 the jar guide 11 is moved back to its initial position where it operates the stop switch 41. At the same time first torsion spring 22 is deflected in the anti-clockwise direction under load. The jar 43 and closure 44 are released and the freed closure 44 can be removed from the jar 43 with little effort.

Embodiments of the invention have been described, however it is understood that variations, improvements or modifications can take place without departure from the spirit of the invention or scope of the appended claims.

Where in the foregoing description reference has been made to integers or elements having known equivalents then such are included as if individually set forth herein.

What is claimed is:

1. An opener for a container having a screw or twist off closure comprising:

a housing, a rotational drive shaft having a stationary position, a first rotational guide and a first spring connecting the first guide to the housing, the first spring having a deflected position storing rotational energy when the shaft is in the stationary position, a second rotational guide coaxial with the first guide, a first pair of opposed jaws slidably provided on the first guide, a first coupling device connecting the first jaws to the housing so that rotation of the first guide causes movement of the first jaws along the first guide, a second pair of opposed jaws slidably provided on the second guide, a second coupling device connecting the second jaws to the shaft so that rotation of the shaft causes movement of the second jaws along the second guide, and the shaft being rotatable in a first direction to move the second jaws to engage a closure of a container between the jaws, and thereby rotational energy in the first spring is released to move the first jaws to engage the container.

2. The opener of claim 1 further including a second spring connecting the second guide to the first guide, the second spring being deflectable to store rotational energy when the shaft rotates in the first direction.

3. The opener of claim 1 further including a switch for causing the shaft to rotate in an opposite direction after the closure has been rotated relative to the container.

4. The opener of claim 1 wherein the second coupling device includes a cam coupled to the shaft and arms between the cam and second jaws.

5. The jar opener of claim 1 wherein the shaft encloses a movable pin, the pin protruding from an end of the shaft and movable to start the shaft rotating when the container is placed between the jaws.

* * * * *